US006412579B2

(12) United States Patent
Fielder

(10) Patent No.: US 6,412,579 B2
(45) Date of Patent: Jul. 2, 2002

(54) TWO STAGE DRILL BIT

(75) Inventor: Coy M. Fielder, Cypress, TX (US)

(73) Assignee: Diamond Products International, Inc., Houston, TX (US)

( * ) Notice: Subject to any disclaimer, the term of this patent is extended or adjusted under 35 U.S.C. 154(b) by 0 days.

(21) Appl. No.: 09/321,362

(22) Filed: May 27, 1999

Related U.S. Application Data

(60) Provisional application No. 60/088,010, filed on May 28, 1998.

(51) Int. Cl.[7] ..... E21B 10/26

(52) U.S. Cl. ..... 175/385; 175/391

(58) Field of Search ..... 175/385, 391, 175/334, 335, 386

(56) References Cited

U.S. PATENT DOCUMENTS 5,992,547 A * 11/1999 Caraway et al. ..... 175/385
5,992,548 A * 11/1999 Silva et al. ..... 175/385

* cited by examiner

*Primary Examiner*—William Neuder
(74) *Attorney, Agent, or Firm*—Gregory M. Luck, Esq.; Sankey & Luck, L.L.P.

(57) ABSTRACT

A bi-center downhole drilling bit is disclosed, which bit includes a body defining proximal and distal ends, where said distal end defines a pilot and a reamer where the reamer defines a first cutting face having a selected diameter "d" and the pilot defines a second cutting face having a selected diameter less than "d", where each the first and second cutting faces includes upsets defining proximal and distal surfaces where the distal surfaces are provided with cutting elements and the proximal surfaces are provided with one or more gauge pads.

12 Claims, 2 Drawing Sheets

TWO STAGE DRILL BIT

REFERENCE TO PROVISIONAL APPLICATION

Pursuant to 35 U.S.C. § 119(e), this application derives from a provisional application for the same invention filed on May 28, 1998, Provisional Ser. No. 60/088,010.

BACKGROUND OF THE INVENTION

1. Field of the Invention

The present invention generally relates to downhole cutting tools. More specifically, the present invention relates to a downhole drill bit which includes both a first and second cutting section, and methods for its use.

2. Description of the Prior Art

Conventional downhole drill bits are usually characterized by a body which defines at its proximal end a shank for attachment to a drill string and a distal end which terminates in a cutting face on which are disposed a plurality of cutting elements. Such conventional drill bits operate by boring a hole slightly larger than their maximum outside diameter. This borehole is achieved as a combination of the cutting action of the rotating bit and the weight on the bit created as a result of the mass of the drill string.

When a bore has been formed through a given formation, the rock immediately surrounding the borehole is in many instances quite frangible as a result of the decompression of this surrounding rock. Such decompression of the surrounding country rock has traditionally been viewed as a nuisance, necessitating casing of the borehole.

SUMMARY OF THE INVENTION

The present invention is directed to a two stage drilling tool which comprises a body defining a proximal end and a distal end, where said proximal end defines a shank for attachment to the drill string. The distal end defines a first drilling face having a certain outside diameter, which first face is disposed above and set apart from a second drilling face having a larger outside diameter, where both the first and second diameters are provided with gauge pads to stabilize the bit in the borehole.

The drill bit of the invention offers a number of advantages. One such advantage is enhanced stability of operation. A second advantage is increased rate of penetration as a result of the decompression of the rock effected by the smaller, first drilling face.

DETAILED DESCRIPTION OF THE PREFERRED EMBODIMENTS

Figure 1:
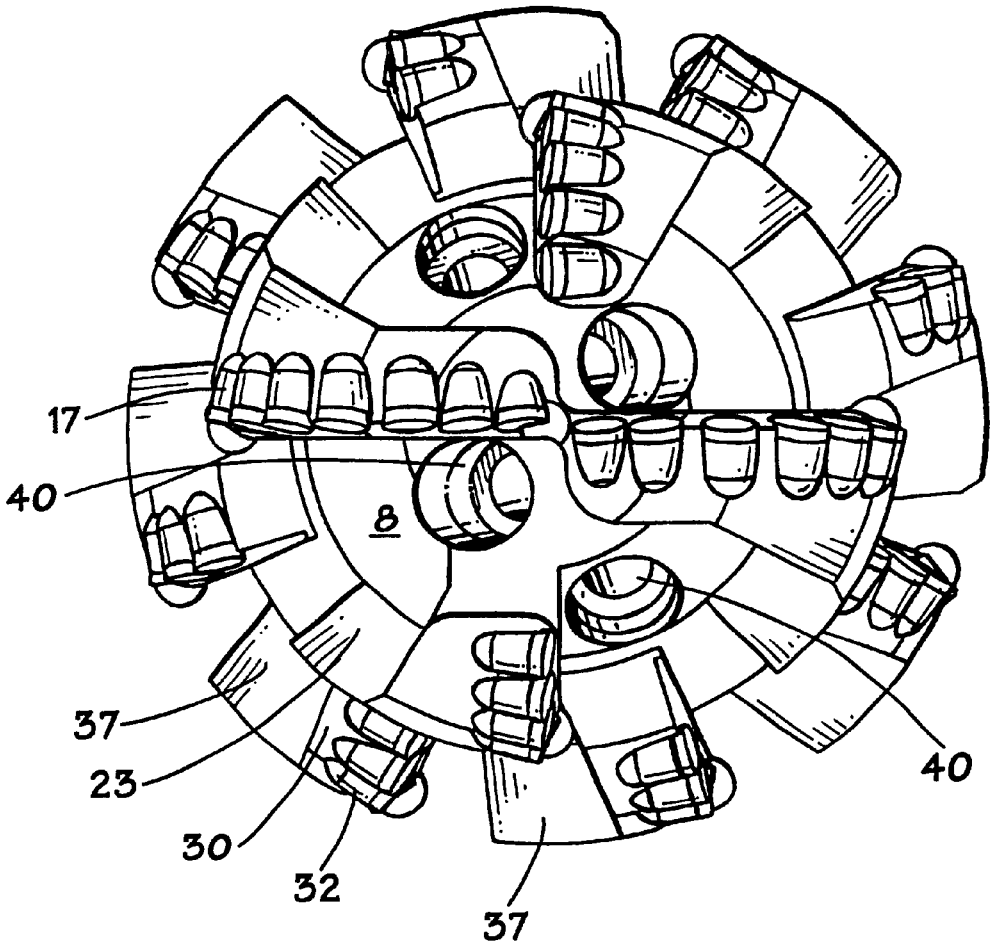
FIG. 1 is a bottom view of one embodiment of the drill bit of the invention.
Figure 2:
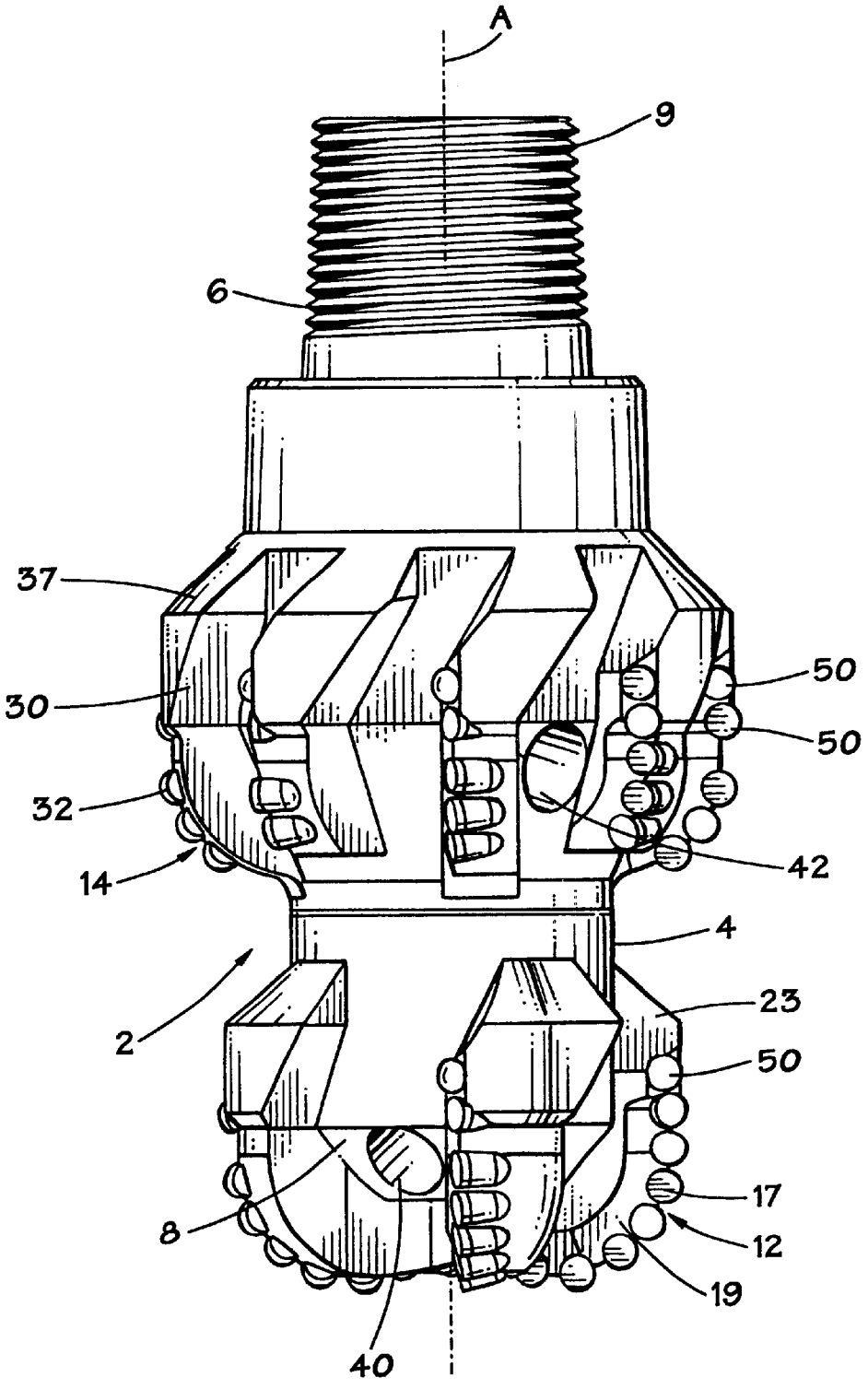
FIG. 2 is a side view of the embodiment illustrated in FIG. 1.

The drill bit of the present invention may be seen by reference to FIGS. 1 and 2.

By reference to the figures, a drill bit 2 having a body 4 including proximal 6 and distal ends 8, where the proximal end 6 defines a threaded shank 9 for attachment to a drill string (not shown). The distal end 8 defines a first 12 and second 14 cutting face, said first cutting face 12 describing a selected outside diameter defined by cutters 17 positioned about one or more upsets or cutter arms 19. The upsets or cutter arms 19 are preferably distributed around the entire circumference of the bit body 4. Below these cutter areas are positioned gauge pads 23 to stabilize the bit 2 during operation.

Proximate to and separated from the first cutting face 12 is a second cutting face 14 which also includes a series of upsets 30 on which are positioned a plurality of cutting elements 32, which cutting elements 32 describing an outside diameter larger than that of the first cutting face 12. The upsets or cutter arms 30 of this second cutting face 14 are also preferably distributed around the entire circumference of the bit 2. Below these upsets 30 are also positioned a second set of gauge pads 37 to further stabilize the drill bit during operation in the borehole.

Each of the first 12 and second 14 cutting faces include one or more fluid nozzles 40 which are situated between upsets 19 and 30, as illustrated. Fluid is pumped down the drill string and out said nozzles 40 to add in cleaning bit faces 12 and 14 as well as monitoring said faces in a preferred temperature range.

The two stage drill bit of the present invention is constructed in the following manner. An evaluation is made of the formation of application for the tool. If the formation is comparatively hard, e.g. 8–15 ft/hr penetration rate predicted, a two stage bit is selected which employs a large number of upsets with reduced spacing between upsets. On a 8½" bit, this might entail incorporating 6 upsets on the first stage and 9 upsets on the second stage. If a softer formation is encountered, e.g. a projected penetration rate of 80–120 ft/hr, fewer upsets will be employed to aid in cleaning the tool during operation. For a 6½" bit, this might entail incorporating 4 upsets on the first stage and 4 upsets on the second stage. These upsets are oriented about the respective bit faces 12 and 14. in a manner consistent with conventional practice.

The upsets themselves are configured to employ a relatively flattened top with a rounded mid section and a flattened bottom area (See FIG. 2). In such a fashion, the upsets define an arc which has slightly flattened end points. A line is drawn perpendicular to this arc at a point along its length to determine the placement of shaped cutting elements 50. Where the line is normal to the axis "A" drawn through the tool, a shaped cutter 50, such as that described in applicants' U.S. Pat. No. 5,803,196, is placed on each upset. Typically, one such shaped cutter 50 will be placed on each blade of the first stage cutting face 12 and two shaped cutters 50 are positioned on each blade of the second stage cutting face 14. Conventional cutting elements 17 are then positioned about the remaining areas about the upsets in accordance with conventional force balancing procedures.

The relative juxtaposition of the first and second stages of the tool 2 are determined so as to allow a substantially complete offset or misalignment between the upsets comprising the first and second stages. Such alignment also serves to offset nozzles 40 on both stages to further aid in cleaning the tool during operation in the borehole.

Gauge pads 23 and 37 are then affixed to upsets 19 and 30 in the manner illustrated in FIGS. 1 and 2. Gauge pads 23 and 37 define a length "L", a width "W" and an angulation "O" as measured along a line parallel to axis "A". When affixed on bit 2, gauge pads define arc segments of a 360° circle. In a preferred embodiment, the total arc segment angle defined by gauge pads for both the first and second stage is 360°±190°.

The operation of the present invention may be seen by reference to the following examples:

EXAMPLE 1

A two stage drill bit of the invention having a pilot with six blades, a 6¾" outer diameter containing six shaped cutters and 240° of wall contact area and a reamer with an 8½" outer diameter with nine blades containing nine shaped cutters and 270° of wall contact area —the total wall contact area for the bit being 330°, was inserted in a borehole formed in a sandstone formation at 13,460 feet. The tool was operated for 36.5 hours with an average WOB of between 12–15,000 lbs. at 230 r.p.m. 561 feet were drilled while the tool was in the hole for an average rate of penetration of 15.4/hour. When pulled from the hole, the cutters were in very good condition and only demonstrated minor wear.

The rate of penetration for the bi-center bit of the invention compared with an average rate of penetration of 10.4/hr for a conventional one stage drill bit in the same formation.

EXAMPLE 2

A two stage bit of the invention having a pilot with four blades, a 5" outer diameter containing four shaped cutters and 220° of wall contact area and a reamer with four blades, a 6½" outer diameter containing eight shaped cutters and 256° of wall contact area —the total wall contact area for the bit being 360°, was inserted in the borehole formed in sandy shale at a depth of 10,572 feet. The tool was operated for 129 hours with an average WOB of between 2–3,000 lbs. at a minimum of 80 rpm. 1,186 feet were drilled while the tool was in the hole for an average rate of penetration of 14.6 ft/hr.

This compares with a ROP for a capacity bit of 10.8 for the identical formation and operating parameters for 109.5 hours of drilling.

EXAMPLE 3

A two stage bit of the invention having a pilot with five blades, a 7" outer diameter containing five shaped cutters and 240° of wall contact area and a reamer with ten blades, a 9⅞" outer diameter containing ten shaped cutters and 120° of wall contact area —the total wall contact area for the bit being 240°, was inserted in a borehole found in a sandy shale formation at a depth of 5,566 feet. The tool was operated for 118.5 hours with an average WOB of between 15–18,000 lbs. at a minimum 65 r.p.m. 3,814 feet were drilled while the tool was in the hole for an average penetration rate of 30.5 ft/hr.

The ROP for the bi-center bit of the invention compared with a ROP of 21.16 for a comparative bit.

EXAMPLE 4

A two stage bit of the invention having a pilot with four blades, a 6¾" outer diameter containing four shaped cutters and 196° of wall contact area and a reamer with eight blades, a 8½" outer diameter containing eight shaped cutters and 240° of outer wall contact area —the total wall contact area for the bit being 304 degrees, was inserted in a borehole formed in a mixed sandstone/limestone/shale formation at a depth of 14,157 feet. The tool was operated for 25.6 hours with an average WOB of between 13–22,000 lbs. at a minimum of 70 r.p.m. and a maximum of 140 r.p.m. 571 feet were drilled while the tool was in the hole for an average penetration rate of 22.3 feet/hour.

This ROP compares with a ROP for 11.7 ft/hr for a capacity bit.

The bit 2 of the present invention is capable of enhanced rates of penetration when compared to conventional downhole drilling bits. This rate of penetration is a result of the increased penetration rate made possible as a result of smaller contact area. When the initial borehole has been created, the rock surrounding the borehole is stress relieved. As a result of what is referred to as the edge effect, the second, larger diameter drilling face 14 is able to easily widen the borehole to a desired borehole diameter.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. A two stage bit enabling enhanced penetration rates comprising:

a body defining a proximal end adapted for connection to a drilling string and a distal end, where said distal end defines a pilot and an intermediate reamer section;

where said pilot includes a first cutter face defining a given diameter D;

where said reamer section includes a second cutter face defining a given diameter R where R>D;

where the first cutter face includes upsets where each upset defines an upper and a lower portion where said upper portion is provided with a series of cutting elements and said lower portion is provided with a surface adapted to extend to gauge into substantially non-cutting contact with the formation;

where the second cutter face includes upsets which extend substantially to gauge and which extend over 180° of the rotational circumference of said reamer where said upsets define an upper and a lower portion where said upper portion is provided with a series of cutting elements; and where the upsets formed on the pilot section are misaligned relative to the upsets formed on the reamer section.

2. The two stage bit of claim 1 where said lower portion includes a gauge pad which extends to gauge.

3. The two stage bit of claim 1 where said cutting elements are formed of polycrystalline diamond.

4. An anti-whirl two stage bit comprising:

a body defining a proximal end adapted to be connected to a drilling string and a distal end, where said distal end defines a pilot and a reamer section;

where said pilot includes a cutting face having a first diameter where said cutting face is comprised of two or more cutting blades defining proximal and distal surfaces;

where said reamer includes a cutting face having a second diameter where said cutting face is comprised of two or more cutting blades defining proximal and distal surfaces where said blades extend over at least 180° of the rotational circumference of the reamer and extend substantially to gauge;

where the first diameter is less than said second diameter;

where cutting elements are disposed on the distal surfaces of said cutting blades and where said proximal surfaces are adapted to slidably engage the formation during rotation of the bit; and where the cutting blades on the pilot are misaligned relative to the cutting blades on the reamer.

5. The bit of claim 4 where the proximal surfaces extend to gauge.

6. The bit of claim 5 where the proximal surfaces define at least one gauge pad.

7. A two stage bit comprising:

a body defining an upper end adapted for connection to a drilling string and a lower end where said lower end defines a first and a second stage;

said first stage comprised of two or more cutting blades adapted to accommodate a series of cutting elements, said first section further defining a maximum diameter P;

said second stage defining a second cutting face comprised of a series of cutting blades about at least 180° of the rotational circumference of said face, where at least a portion of said blades extend substantially to gauge in to substantially non-cutting contact with the formation, where said second section further defines a maximum diameter R;

said first and second stages being vertically segregated by a zone having no cutting blades and which defines a smaller diameter than either said first or second stage.

8. The two stage bit of claim 7 further including gauge pads disposed about the first and second stages.

9. The two stage bit of claim 7 where the rotational circumference of the cutting blades on both the first and second stages is at least 240°.

10. The two stage bit of claim 7 where the upsets of one or both of the first and second stages is angled with resect to the direction of rotation.

11. The two stage bit of claim 7 where R>P.

12. The two stage bit of claim 11 where the diameter of the first stage is at least 50% of the diameter of the second stage.

* * * * *

UNITED STATES PATENT AND TRADEMARK OFFICE

CERTIFICATE OF CORRECTION

PATENT NO. : 6,412,579 B2
DATED : June 2, 2002
INVENTOR(S) : Fielder

It is certified that error appears in the above-identified patent and that said Letters Patent is hereby corrected as shown below:

Column 2,
Line 65, please replace "360º ± 190º" with -- 360º ± 90º --.

Column 5,
Line 15, please replace "in to" with -- into --.

Signed and Sealed this

Third Day of December, 2002

JAMES E. ROGAN
*Director of the United States Patent and Trademark Office*